United States Patent [19]

Klosek et al.

[11] 4,358,364

[45] Nov. 9, 1982

[54] PROCESS FOR ENHANCED BENZENE-SYNTHETIC NATURAL GAS PRODUCTION FROM GAS CONDENSATE

[75] Inventors: Joseph Klosek, Wescosville; John C. Tao, Allentown, both of Pa.

[73] Assignee: Air Products and Chemicals, Inc., Allentown, Pa.

[21] Appl. No.: 262,281

[22] Filed: May 11, 1981

[51] Int. Cl.[3] ..... C10G 63/06

[52] U.S. Cl. ..... 208/92; 48/197 R; 208/62; 208/79; 208/80

[58] Field of Search ..... 208/92, 62, 79, 80; 48/197 R

[56] References Cited

U.S. PATENT DOCUMENTS

| | | | |
|---|---|---|---|
| 3,281,351 | 10/1966 | Gilliland et al. | 208/67 |
| 3,388,055 | 6/1968 | Craig et al. | 208/143 |
| 3,406,217 | 10/1968 | Davison et al. | 585/253 |
| 3,409,540 | 11/1968 | Gould et al. | 208/79 |
| 3,732,085 | 5/1973 | Carr et al. | 48/214 |
| 3,761,392 | 9/1973 | Pollock | 208/93 |
| 4,000,206 | 12/1976 | Drehman | 585/317 |
| 4,162,214 | 7/1979 | Maslyansky et al. | 585/471 |
| 4,222,854 | 9/1980 | Vorhis, Jr. et al. | 208/80 |

*Primary Examiner*—Curtis R. Davis

*Attorney, Agent, or Firm*—Geoffrey L. Chase; E. Eugene Innis; James C. Simmons

[57] ABSTRACT

An upgraded benzene-synthetic natural gas product is produced from hydrocarbon gas condensate feedstock by catalytically reforming a $C_6$-300° F. B.P. fraction and hydrogasifying the remainder of the feedstock. The overall efficiency of the process is enhanced by dealkylation of certain intermediate streams in the process and by recycling certain other aromatic and hydrogen-rich streams within the process.

14 Claims, 1 Drawing Figure

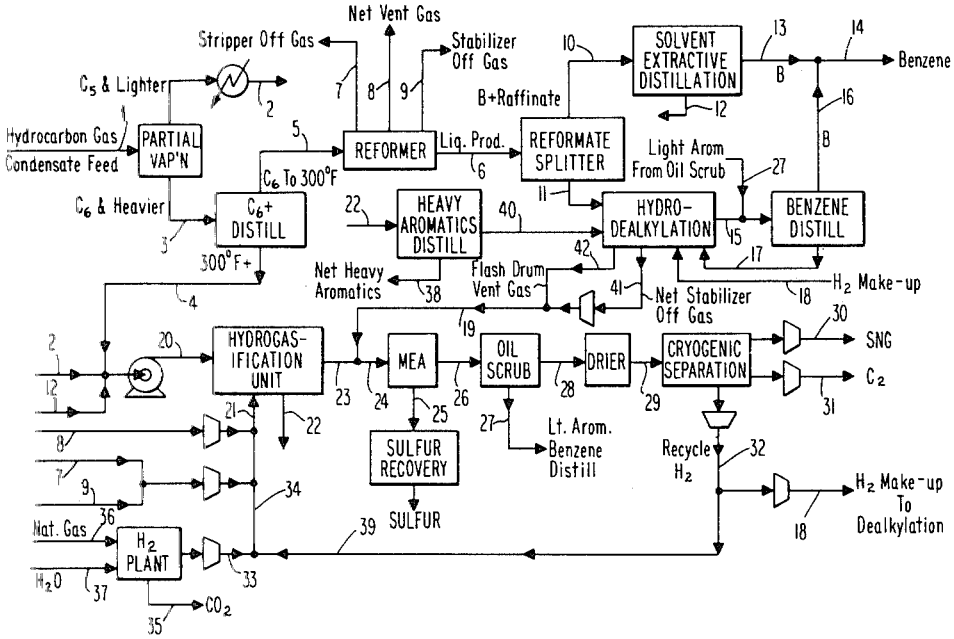

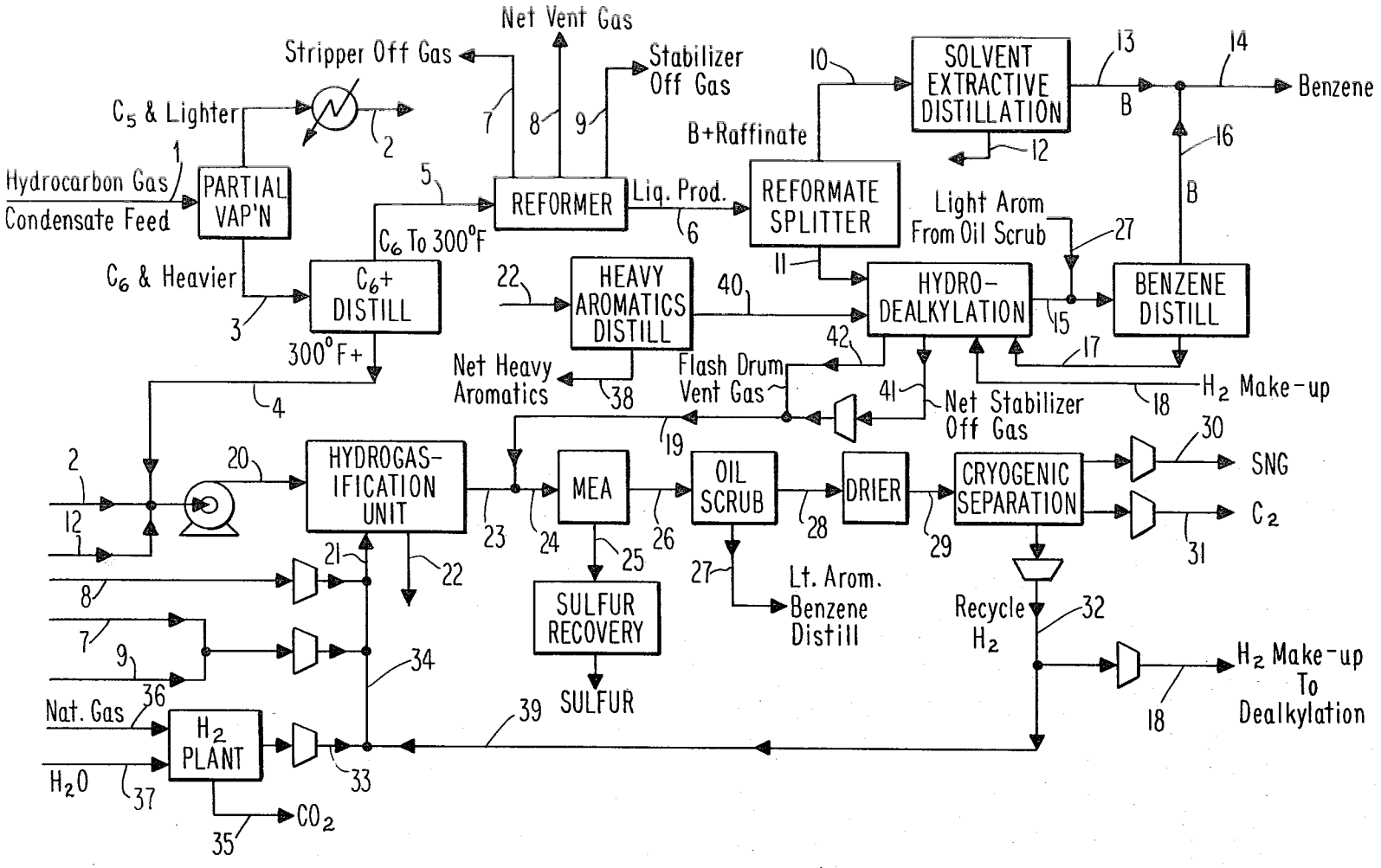
Benzene
SOLVENT EXTRACTIVE DISTILLATION
BENZENE DISTILL
H2 Make-up
SNG
C2
H2 Make-up To Dealkylation
Light Arom From Oil Scrub
HYDRO-DEALKYLATION
Net Stabilizer Off Gas
CRYOGENIC SEPARATION
Recycle H2
REFORMATE SPLITTER
DRIER
Lt. Arom. Benzene Distill
B+Raffinate
Stabilizer Off Gas
Liq. Prod.
HEAVY AROMATICS DISTILL
Flash Drum Vent Gas
OIL SCRUB
Net Vent Gas
REFORMER
MEA
SULFUR RECOVERY
SULFUR
Net Heavy Aromatics
Stripper Off Gas
C6 To 300°F
C6+ DISTILL
300°F+
HYDROGAS-IFICATION UNIT
PARTIAL VAP'N
C5 & Lighter
C6 & Heavier
Hydrocarbon Gas
Condensate Feed
H2 PLANT
CO2
Nat. Gas
H2O

PROCESS FOR ENHANCED BENZENE-SYNTHETIC NATURAL GAS PRODUCTION FROM GAS CONDENSATE

TECHNICAL FIELD

This invention pertains to a method for upgrading a hydrocarbon gas condensate by an integrated reforming and gasification process to produce synthetic natural gas (SNG) and benzene.

BACKGROUND OF PRIOR ART

Various processes are known for upgrading hydrocarbon streams, such as natural gas condensates and crude oil fractions with boiling point characteristics similar to natural gas condensate, by fractionation and conversion, including reforming, of certain fractions thereof. This is illustrated by the following patents, which have been cited in a report based on a search directed to the present invention:

U.S. Pat. Nos. 3,281,351—Gilliland et al.
3,388,055—Craig et al.
3,406,217—Davison et al.
3,409,540—Gould et al.
3,732,085—Carr et al.
3,761,392—Pollock;
4,000,206—Drehman;
4,162,214—Maslyansky et al.
4,222,854—Vorhis, Jr., et al.

In the process disclosed in the Vorhis et al patent, a naphtha feedstock with a boiling point range of 100°-550° F., is fractionated and the mid-cut (boiling point 220°-300° F.) is reformed. Separately, the lower and upper fractions are recombined and reformed, all of the reforming being directed to produce gasoline components.

In the Carr et al process, crude oil is fractionated and its heavier components hydrocracked to produce naphtha, which is in turn reformed along with a middle fraction of the crude to form synthetic natural gas. Benzene, however, is apparently not a significant product in this process.

Maslyansky et al enhances between production from reformate by hydrocracking a high boiling fraction of the reformate and separating aromatic products from the hydrocracked product while recycling the remainder for further hydrocracking, so as to upgrade substantially all of the reformate to aromatic products. Some gaseous by-products, with ethane predominating in the examples, is also produced in the hydrocracking process; toluene is recycled so that the primary reaction is one of dealkylation of higher aromatics to benzene; the process conditions, hydrogen atmosphere, elevated temperature, a pressure of 10-60 atmospheres, and a catalyst consisting of mordenite and a hydrogenating agent, are apparently designed to maximize aromatic yield, not gasified products.

Unlike the other references cited above, the Drehman patent indicates that the feedstock in the process of that patent may be a natural gas liquid. This feedstock is said to be a $C_6$ hydrocarbon stream which is converted to benzene, a cyclohexane, and a motor fuel blending stock by fractionation, hydrogenation, and isomerization. The benzene and fuel gas result from fractionation of a reformate produced from a feedstock consisting primarily of normal hexane, in turn produced as a middle cut from a succession of three fractionators. Substantially all other fractions are hydrogenated, isomerized, and fractionated to produce motor fuel and cyclohexane, and none is gasified.

The remaining patents cited above are of interest only for their showing of separate treatment of fractionated crude oil or gasoline stocks, some fractions of which are separately hydrocracked or, as in the Pollock and Gould et al patents, reformed.

None of the known published references suggest a process, as in the present invention, involving the integrated conversion to benzene and synthetic natural gas, of natural gas condensate.

Another process is known, however, though not known to be disclosed in any published reference, in which natural gas condensate is converted to benzene and synthetic natural gas streams by reforming essentially the entire natural gas condensate feedstock, then separating benzene therefrom and gasifying the remainder.

Notwithstanding this prior art, there remains a need for further upgrading natural gas condensate and more particularly a need for a process to enhance the product value yield of the natural gas condensate conversion.

It is therefore a general object of the present invention to provide a process for increasing the proportion of benzene in the benzene, synthetic natural gas product mix of a gas condensate conversion process.

BRIEF DESCRIPTION OF INVENTION

This object is met, in accordance with the present invention, by a process wherein a hydrocarbon gas condensate, particularly a natural gas condensate, is partially vaporized and the unvaporized liquid is distilled to produce a fraction having a boiling point range from the boiling point of hexane to 300° F. This material is reformed to produce a BTX (benzene, toluene, zylene) fraction from which benzene is separated by solvent extractive distillation.

The remaining fractions are gasified in a hydrogen-rich atmosphere preferably in a high efficiency adiabatic reactor gasification unit, such as a gas recycle hydrogasification unit (GRH) of the type sold commercially by the British Gas Corporation.

The heavy aromatics from the hydrogasification unit are distilled to produce a heavy aromatics product and a lighter fraction. This lighter fraction, along with the bottoms of a reformate splitter, is fed to a hydrodealkylation unit to produce more benzene.

The remaining hydrogasification unit product is combined with the flash drum vent gas from the reformer and stabilizer off-gas from the hydrodealkylation unit and are treated to recover sulfur and produce more benzene, SNG and $C_2$ products. A relatively pure hydrogen stream is left after recovering the SNG and $C_2$ fractions and part of this hydrogen is used for the hydrodealkylation unit. The remaining hydrogen, along with the make-up hydrogen from a hydrogen plant, is recycled to the hydrogasification unit.

For a better understanding of this invention, reference may be made to the detailed description thereof which follows, taken in conjunction with the accompanying Figure and the appended claims.

BRIEF DESCRIPTION OF THE FIGURE

The accompanying FIGURE is a diagrammatic illustration of the process of the present invention in its preferred embodiment.

DETAILED DESCRIPTION OF THE INVENTION

With reference to the Figure, the present invention is carried out as follows: Natural gas condensate 1 is partially vaporized into a $C_5$ and lighter stream 2 which is condensed and then passed to a hydrogasification unit, preferably a GRH or comparable unit, while the $C_6$ and heavier separated stream 3 is distilled into a $C_6$ to 300° F. upper stream 5 and a 300° F.+ bottom stream 4, which is also passed to the hydrogasification unit. The $C_6-300°$ F. stream 5 is reformed, for example, in a Houdriformer of the type licensed by Air Products & Chemicals, Inc. of Allentown, Pennsylvania, to produce an aromatic-rich product.

The reformer consists of a catalytic pretreatment stage to remove sulfur followed by three reactor beds with intermediate heating. Effluent from the third reactor preheats the reformer feed and then enters a high pressure separator and is stabilized to form the reformate product. By-product gas streams 7, 8, and 9 are compressed, and fed to the hydrogasification unit. The stabilized reformate stream 6 is split into a benzene-rich overhead stream 10 and toluene-xylene-rich bottom stream 11. Benzene product stream 13 is recovered from stream 10 by a solvent extractive distillation process, such as the Distapex process, which is commercially available from its developer, Lurgi Kohle und Mineraloltechnik Gmbh of Frankfurt, Germany. The raffinate stream 12 from the solvent extractive distillation step is also sent to the hydrogasification unit, where it is combined with above-referenced streams 2 and 4 and compressed into combined gasification unit feed stream 20.

Final benzene product stream 14 results when benzene product stream 13 is combined with overhead stream 16 of a benzene distillation unit.

Heavy aromatics stream 22 of the hydrogasification unit is separated, by distillation, into a net heavy aromatics product stream 38 and an overhead stream 40, which is combined with reformate splitter bottom stream 11 and fed to a dealkylation unit where higher aromatics are converted to benzene. Product stream 15 of the dealkylation unit, is combined with a light aromatic stream 27, from the oil scrubbing unit and sent to a benzene distillation unit where benzene is separated 16 from a bottom stream 17 which is recycled to the hydrodealkylation unit.

The dealkylation unit may be a Detol unit as licensed by Air Products & Chemicals, Inc. of Allentown, Pennsylvania. This unit gives high yield of high purity benzene from a wide variety of charge stocks including toluene, xylene and higher alkyl benzene homologs.

In the dealkylation unit, feed (toluenes, and xylenes, and/or $C_9$+ aromatics), together with a hydrogen containing stream, is heated at a specified pressure to the required reaction temperature and passed over a dealkylation catalyst. Reactor effluent is cooled by heat exchange. Benzene and unconverted toluene and/or xylene and heavier aromatics are condensed, then flow to a high pressure flash drum where the major portion of materials which boil below benzene are separated as gases.

The condensed liquid consisting of benzene, toluene, and/or xylene and heavier aromatics is pumped to a stabilizer. Dissolved hydrogen, hydrogen sulfide, and light hydrocarbons not removed in the flash drum are stripped out. The benzene products may be further decolorized by an acid wash.

The hydrogasification unit hydrogasifies the combined feed streams 20 and 21 in a hydrogen atmosphere to form a methane, ethane, and benzene stream 23. In addition a heavy aromatics stream 22 is produced which is sent to the heavy aromatics still.

The hydrogasification unit product stream 23 is combined with compressed stabilizer off-gas 41 and flash drum vent gas stream 42 from the dealkylation unit to form stream 24 from which sulfur is removed as stream 25 in a monoethanolamine extraction desulfurization unit (MEA). Desulfurized stream 26 is then oil scrubbed to remove a light aromatic stream 27 for additional benzene recovery in the benzene distillation unit. The vapor stream 28 is dried and sent to a cryogenic unit to separate synthetic natural gas 30, a stream 31 consisting mostly of ethane and hydrogen 22, some of which is recycled to the hydrodealkylation unit as stream 18. The remaining recycle hydrogen stream 39 is combined with make-up hydrogen stream 33 to form stream 34 which furnishes hydrogen for the hydrogasification unit.

Hydrogen is the make-up stream 33, may be produced by any commercially available process. By way of illustration in the process depicted, a natural gas stream 36 is reacted catalytically with stream 37 in a hydrogen reforming plant. After scrubbing to remove $CO_2$, the hydrogen is compressed to the desired pressure for the hydrogasification unit.

By way of example, the FIGURE depicts a process which may be utilized to produce about 10,000 barrels per day of benzene (stream 14), 70 MMSCFD of synthetic natural gas (stream 30) and 36 MMSCFD of ethane (stream 31), from 35,000 barrels per day of Alberta natural gas condensate (stream 1). The synthetic natural gas stream is calculated to be 83% methane, 11% ethane, and 6% hydrogen, while the ethane stream is about 87% ethane, 8% ethylene, and 5% propane. With suitable Claus units associated with the desulfurization unit, about 1000 pounds per hour of by-product sulfur can be removed. About 8700 pounds per hour of naphthalene and anthracene are recovered in aromatic stream 38. The overall process thermal efficiency (including credit for calculated steam export) is close to 90%.

For a more specific breakdown of the process conditions and stream flow rates in this example, reference may be made to the Table, which is a calculated mass balance for this process.

TABLE

| | VAPOR IN LB MOLES/HR LIQUID IN (LBS/HR) | | | |
|---|---|---|---|---|
| STREAMS | 1 | 2 | 3 | 4 |
| PRESSURE (PSIA) | 14.7 | 70 | 15 | 15 |
| TEMPERATURE (°F.) | 60 | 115 | | 330 |
| $H_2$ | | | | |
| $C_1$ | | | | |
| $C_2$ | | | | |
| $C_2^=$ | | | | |

TABLE-continued

| | | VAPOR IN LB MOLES/HR LIQUID IN (LBS/HR) | | | |
|---|---|---|---|---|---|
| | $C_3$ | (801) | (801) | | |
| | $C_4$ | (14,944) | (14,944) | | |
| | $C_5P$* | (52,206) | (52,206) | | |
| | $C_6P$ | (41,543) | | (41,543) | |
| | $C_7P$ | (30,277) | | (30,277) | |
| | $C_8P$ | (21,828) | | (21,828) | |
| | $C_9P^+$ | (49,374) | | (49,374) | (49,374) |
| | $C_5N$* | (2,378) | | (2,378) | |
| | $C_6N$ | (14,384) | | (14,384) | |
| | $C_7N$ | (25,970) | | (25,970) | |
| | $C_8N$ | (15,183) | | (15,183) | |
| | $C_9N^+$ | (31,067) | | (31,067) | (31,067) |
| Benzene | | (3,135) | | (3,135) | |
| Toluene | | (13,883) | | (13,883) | |
| (Aromatics) | $C_8$ | (24,184) | | (24,184) | |
| (Aromatics) | $C_9^+$ | (34,916) | | (34,916) | (34,916) |
| (Naphthalene) | N | (1,776) | | (1,776) | (1,776) |
| (Anthracene) | A | | | | |
| | $H_2S$ | | | | |
| | $H_2O$ | | | | |
| | $CO_2$ | | | | |
| Total | | (377,849) | (67,951) | (309,898) | (117,133) |
| M.W. | | | | | |
| Remarks | | 35,000 BBL/D,0.3 WT. % S = 1134 LB/HR | | Includes 1134 LB/ HR S | Includes 556 LB/HR S |

*P = Paraffin
N = Naphthene

| STREAMS | | 5 | 6 | 7 | 8 |
|---|---|---|---|---|---|
| PRESSURE (PSIA) | | 50 | | 115 | 175 |
| TEMPERATURE (°F.) | | 105 | | | |
| | $H_2$ | | | 37 | 2,120 |
| | $C_1$ | | | 2 | 138 |
| | $C_2$ | | | 2 | 196 |
| | $C_2$= | | | | |
| | $C_3$ | | | 2 | 167 |
| | $C_4$ | | | 1 | 86 |
| | $C_5P$ | | (9,672) | | 29 |
| | $C_6P$ | (41,543) | | | |
| | $C_7P$ | (30,277) | (25,898) | | 14 |
| | $C_8P$ | (21,828) | | | |
| | $C_9P^+$ | | | | |
| | $C_5N$ | (2,378) | | | |
| | $C_6N$ | (14,384) | | | |
| | $C_7N$ | (25,970) | | | |
| | $C_8N$ | (15,183) | | | |
| | $C_9N^+$ | | | | |
| Benzene | | (3,135) | (19,224) | | 11 |
| Toluene | | (13,883) | (44,812) | | 7 |
| (Aromatics) | $C_8$ | (24,184) | (48,774) | | 3 |
| (Aromatics) | $C_9^+$ | | (1,924) | | |
| | N | | | | |
| | A | | | | |
| | $H_2S$ | | | 18 | |
| | $H_2O$ | | | | |
| | $CO_2$ | | | | |
| Total | | (192,765) | (150,304) | 62 | 2,771 |
| M.W. | | | | 15.3 | 10.77 |
| Remarks | | Includes 578 LB/HR S | | | |

| STREAMS | | 9 | 10 | 11 | 12 |
|---|---|---|---|---|---|
| PRESSURE (PSIA) | | 115 | | | |
| TEMPERATURE (°F.) | | | | 150 | |
| | $H_2$ | 8 | | | |
| | $C_1$ | 4 | | | |
| | $C_2$ | 26 | | | |
| | $C_2$= | | | | |
| | $C_3$ | 71 | | | |
| | $C_4$ | 127 | | | |
| | $C_5P$ | 5 | (9,672) | | (9,672) |
| | $C_6P$ | | | | (14,229) |
| | $C_7P$ | | (23,355) | (667) | (9,122) |
| | $C_8P$ | | | (1,876) | |
| | $C_9P^+$ | | | | |
| | $C_5N$ | | | | |
| | $C_6N$ | | | | |

TABLE-continued

| | | VAPOR IN LB MOLES/HR LIQUID IN (LBS/HR) | | | |
|---|---|---|---|---|---|
| | $C_7N$ | | | | |
| | $C_8N$ | | | | |
| | $C_9N^+$ | | | | |
| Benzene | | | (18,263) | (961) | (195) |
| Toluene | | | (2) | (44,810) | |
| (Aromatics) | $C_8$ | | | (48,774) | |
| (Aromatics) | $C_9^+$ | | | (1,924) | |
| | N | | | | |
| | A | | | | |
| | $H_2S$ | | | | |
| | $H_2O$ | | | | |
| | $CO_2$ | | | | |
| Total | | 241 | (51,292) | (99,012) | (33,218) |
| M.W. | | 48.6 | | | |
| Remarks | | | | | |
| STREAMS | | 13 | 14 | 15 | 16 |
| PRESSURE (PSIA) | | | | | 75 |
| TEMPERATURE (°F.) | | | | | 100 |
| | $H_2$ | | | | |
| | $C_1$ | | | | |
| | $C_2$ | | | | |
| | $C_2=$ | | | | |
| | $C_3$ | | | | |
| | $C_4$ | | | | |
| | $C_5P$ | | | | |
| | $C_6P$ | | | | |
| | $C_7P$ | (4) | (31) | | (27) |
| | $C_8P$ | | | | |
| | $C_9P^+$ | | | | |
| | $C_5N$ | | | | |
| | $C_6N$ | | | | |
| | $C_7N$ | | | | |
| | $C_8N$ | | | | |
| | $C_9N^+$ | | | | |
| Benzene | | (18,068) | (128,706) | | (110,638) |
| Toluene | | (2) | (13) | | (11) |
| (Aromatics) | $C_8$ | | | | |
| (Aromatics) | $C_9^+$ | | | | |
| | N | | | | |
| | A | | | | |
| | $H_2S$ | | | | |
| | $H_2O$ | | | | |
| | $CO_2$ | | | | |
| Total | | (18,074) | (128,750) | | (110,676) |
| M.W. | | | | | |
| Remarks | | | | | |
| STREAMS | | 18 | 19 | 20 | 21 |
| PRESSURE (PSIA) | | 785 | | 665 | 665 |
| TEMPERATURE (°F.) | | 120 | | | |
| | $H_2$ | 4,094 | 2,521 | | 14,073 |
| | $C_1$ | 338 | 1,707 | | 771 |
| | $C_2$ | | 149 | | 224 |
| | $C_2=$ | | | | — |
| | $C_3$ | | 21 | (801) | 240 |
| | $C_4$ | | 3 | (14,944) | 214 |
| | $C_5P$ | | | (61,878) | 34 |
| | $C_6P$ | | | (14,229) | 14 |
| | $C_7P$ | | | (9,122) | |
| | $C_8P$ | | | | |
| | $C_9P^+$ | | | (49,374) | |
| | $C_5N$ | | | | |
| | $C_6N$ | | | | |
| | $C_7N$ | | | | |
| | $C_8N$ | | | | |
| | $C_9N^+$ | | | (31,067) | |
| Benzene | | | 41 | (195) | 11 |
| Toluene | | | 3 | | 7 |
| (Aromatics) | $C_8$ | | | | 3 |
| (Aromatics) | $C_9^+$ | | | (34,916) | |
| | N | | | (1,776) | |
| | A | | | | |
| | $H_2S$ | | 3 | | 18 |
| | $H_2O$ | | | | |
| | $CO_2$ | | | | |
| Total | | 4,432 | 4,448 | (218,302) | 15,609 |
| M.W. | | 3.08 | 9.37 | | |
| Remarks | | | | | |

TABLE-continued

| | | VAPOR IN LB MOLES/HR LIQUID IN (LBS/HR) | | | |
|---|---|---|---|---|---|
| STREAMS | | 22 | 23 | 24 | 25 |
| PRESSURE (PSIA) | | 25 | 525 | | 20 |
| TEMPERATURE (°F.) | | 200 | 115 | | 105 |
| | $H_2$ | | 8,309 | 10,830 | |
| | $C_1$ | | 5,530 | 7,237 | |
| | $C_2$ | | 4,219 | 4,368 | |
| | $C_2=$ | | 309 | 309 | |
| | $C_3$ | | 183 | 204 | |
| | $C_4$ | | | 3 | |
| | $C_5P$ | | | | |
| | $C_6P$ | | | | |
| | $C_7P$ | | | | |
| | $C_8P$ | | | | |
| | $C_9P+$ | | | | |
| | $C_5N$ | | | | |
| | $C_6N$ | | | | |
| | $C_7N$ | | | | |
| | $C_8N$ | | | | |
| | $C_9N+$ | | | | |
| Benzene | | (17,935) | 195 | 236 | |
| Toluene | | (1,436) | 11 | 14 | |
| (Aromatics) | $C_8$ | (439) | 2 | 2 | |
| (Aromatics) | $C_9+$ | (4) | | | |
| | N | (4,028) | | | |
| | A | (4,616) | | | |
| | $H_2S$ | (*139) | 31 | 34 | 34 |
| | $H_2O$ | | | | |
| | $CO_2$ | | | | |
| Total | | (28,957) | 18,790 | 23,237 | 34 |
| M.W. | | | 14.19 | 13.27 | |
| Remarks | | *Organic S | | | |
| STREAMS | | 26 | 27 | 28 | 29 |
| PRESSURE (PSIA) | | 515 | 25 | 510 | 500 |
| TEMPERATURE (°F.) | | 105 | 55 | 110 | 55 |
| | $H_2$ | 10,830 | | 10,830 | 10,830 |
| | $C_1$ | 7,237 | | 7,237 | 7,237 |
| | $C_2$ | 4,368 | | 4,368 | 4,368 |
| | $C_2=$ | 309 | | 309 | 309 |
| | $C_3$ | 204 | | 204 | 204 |
| | $C_4$ | 3 | | 3 | 3 |
| | $C_5P$ | | | | |
| | $C_6P$ | | | | |
| | $C_7P$ | | | | |
| | $C_8P$ | | | | |
| | $C_9P+$ | | | | |
| | $C_5N$ | | | | |
| | $C_6N$ | | | | |
| | $C_7N$ | | | | |
| | $C_8N$ | | | | |
| | $C_9N+$ | | | | |
| Benzene | | 236 | (18,416) | | |
| Toluene | | 14 | (1,334) | | |
| (Aromatics) | $C_8$ | 2 | (217) | | |
| (Aromatics) | $C_9+$ | | | | |
| | N | | | | |
| | A | | | | |
| | $H_2S$ | | | | |
| | $H_2O$ | | | | |
| | $CO_2$ | | | | |
| Total | | 23,203 | (19,967) | 22,951 | 22,951 |
| M.W. | | 13.24 | | 12.51 | 12.51 |
| Remarks | | | | | |
| STREAMS | | 30 | 31 | 32 | 33 |
| PRESSURE (PSIA) | | 1415 | 1415 | 665 | 665 |
| TEMPERATURE (°F.) | | 105 | | 110 | 105 |
| | $H_2$ | 449 | | 10,381 | 5,621 |
| | $C_1$ | 6,382 | | 855 | 110 |
| | $C_2$ | 876 | 3,502 | | |
| | $C_2=$ | | 309 | | |
| | $C_3$ | | 204 | | |
| | $C_4$ | | 3 | | |
| | $C_5P$ | | | | |
| | $C_6P$ | | | | |
| | $C_7P$ | | | | |
| | $C_8P$ | | | | |
| | $C_9P+$ | | | | |
| | $C_5N$ | | | | |

TABLE-continued

| | | VAPOR IN LB MOLES/HR LIQUID IN (LBS/HR) | | | |
|---|---|---|---|---|---|
| | $C_6N$ | | | | |
| | $C_7N$ | | | | |
| | $C_8N$ | | | | |
| | $C_9N^+$ | | | | |
| Benzene | | | | | |
| Toluene | | | | | |
| (Aromatics) | $C_8$ | | | | |
| (Aromatics) | $C_9^+$ | | | | |
| | N | | | | |
| | A | | | | |
| | $H_2S$ | | | | |
| | $H_2O$ | | | | |
| | $CO_2$ | | | | |
| Total | | 7,707 | 4,018 | 11,236 | 5,731 |
| M.W. | | 16.82 | 30.65 | 3.08 | 2.285 |
| Remarks | | 70.2 MMSCFD | 36.6 MMSCFD | | 98.08% $H_2$ |
| STREAMS | | 34 | 35 | 36 | 37 |
| PRESSURE (PSIA) | | 665 | | | |
| TEMPERATURE (°F.) | | 105 | | | |
| | $H_2$ | 11,098 | | | |
| | $C_1$ | 627 | | | |
| | $C_2$ | | | | |
| | $C_2=$ | | | | |
| | $C_3$ | | | | |
| | $C_4$ | | | | |
| | $C_5P$ | | | | |
| | $C_6P$ | | | | |
| | $C_7P$ | | | | |
| | $C_8P$ | | | | |
| | $C_9P^+$ | | | | |
| | $C_5N$ | | | | |
| | $C_6N$ | | | | |
| | $C_7N$ | | | | |
| | $C_8N$ | | | | |
| | $C_9N^+$ | | | | |
| Benzene | | | | | |
| Toluene | | | | | |
| (Aromatics) | $C_8$ | | | | |
| (Aromatics) | $C_9^+$ | | | | |
| | N | | | | |
| | A | | | | |
| | $H_2S$ | | | | |
| | $H_2O$ | | | | |
| | OTHER | | | | |
| Total | | 12,535 | | | |
| M.W. | | 2.718 | | | |
| Remarks | | 95% $H_2$ | | | |
| STREAMS | 38 | 39 | 40 | 41 | 42 |
| | | | NET HEAVY AROMATICS TO DETOL | NET STAB. OFF-GAS | FLASH DRUM VENT |
| PRESSURE (PSIA) | 65 | 665 | | 120 | 775 |
| TEMPERATURE (°F.) | 460 | 105 | | 60 | 120 |
| $H_2$ | | 6,287 | | 20 | 2,501 |
| $C_1$ | | 517 | | 83 | 1,624 |
| $C_2$ | | | | 22 | 127 |
| $C_2=$ | | | | | |
| $C_3$ | | | | 7 | 14 |
| $C_4$ | | | | 2 | 1.4 |
| $C_5P$ | | | | | |
| $C_6P$ | | | | | |
| $C_7P$ | | | | | |
| $C_8P$ | | | | | |
| $C_9P^+$ | | | | | |
| $C_5N$ | | | | | |
| $C_6N$ | | | | | |
| $C_7N$ | | | | | |
| $C_8N$ | | | | | |
| $C_9N^+$ | | | | | |
| Benzene | | | (17,935) | | 39 |
| Toluene | | | (1,436) | 2 | 3 |
| (Aromatics) $C_8$ | (44) | | (395) | | NIL |
| (Aromatics) $C_9^+$ | (3) | | (1) | | |
| N | (4,028) | | | | |
| A | (4,616) | | | | |
| $H_2S$ | | | | | |
| $H_2O$ | | | | | |

TABLE-continued

| | VAPOR IN LB MOLES/HR LIQUID IN (LBS/HR) | | | | |
|---|---|---|---|---|---|
| OTHER | (45)* | | (94)** | | |
| Total | (8,736) | 6,804 | (19,861) | 136 | 4,309.4 |
| M.W. | | 3.081 | | | |
| Remarks | *Organic Sulfur | 92.40% $H_2$ | **Organic S | | |

Basically, the process works by separating hydrocarbon gas condensate into light ($C_5$ and lighter), middle ($C_6$ to 300° F.), and heavy ($C_6$ and heavier) fractions. The light and heavy fractions are hydrogasified, i.e., gasified in a hydrogen atmosphere. Heavy aromatic liquid in the gasification effluent is hydrodealkylated to benzene, which together with the more efficient reforming of the mid-cut stream from the feedstock, accounts for the enhanced benzene production in the integrated process of the present invention. The gasification effluent gas stream is scrubbed, dried, and separated in a cold box to yield the synthetic natural gas and ethane product streams.

While this invention has been described with reference to specific embodiments thereof, it is not limited thereto and the appended claims are intended to be construed to encompass not only the forms of the invention disclosed and shown but also such variations and modifications thereof as may be devised by those skilled in the art without departing from the true spirit and scope of the present invention.

We claim:

1. Method for converting a hydrocarbon gas condensate feedstock into a substantially benzene product and a synthetic natural gas product comprising:
(a) separating said feedstock into three fractions:
(i) $C_5$ and lighter.
(ii) $C_6$ to 300° F. B.P.
(iii) B.P. above 300° F.;
(b) catalytically reforming said fraction (ii) to produce a by-product gas stream and a benzene product; and
(c) hydrogasifying said fractions (i) and (iii) with the gas stream from the reforming in step (b) to produce synthetic natural gas and additional benzene product.

2. A process as recited in claim 1, further comprising splitting said benzene product from step (b) into a benzene plus raffinate product and a heavier aromatic product.

3. A process as recited in claim 1, further comprising solvent extracting said benzene plus raffinate product to produce such benzene and separated raffinate.

4. A process as recited in claim 3, wherein said separated raffinate product is hydrogasified to produce benzene.

5. A process as recited in claim 1, wherein the hydrogasification product is treated to remove sulfur compounds which are then converted to elemental sulfur.

6. A process as recited in claim 5, wherein the desulfurized gasification product is scrubbed with oil to remove its light aromatic content.

7. A process as recited in claim 6, wherein the oil scrubbed gas is dried and sent to a cryogenic unit to separate synthetic natural gas, a $C_2$ fraction product and hydrogen.

8. A process as recited in claim 2, wherein said heavy aromatic product is hydrodealkylated to produce a benzene product.

9. A process as recited in claim 8, wherein a second heavy aromatic stream from said hydrogasification step is separated into a light aromatic split stream and a heavy aromatic product split stream and said light aromatic split stream is hydrodealkylated to produce benzene product.

10. A method for converting a hydrocarbon gas condensate feedstock into a substantially pure benzene product and a synthetic natural gas product comprising the steps of:
(a) initially separating the hydrocarbon gas condensate feedstock into a $C_5$ and lighter stream and a $C_6$ and heavier stream;
(b) separating the $C_6$ and heavier stream into a $C_6$ to 300° F. B.P. stream and a 300° F.+B.P. stream;
(c) reforming said $C_6$ to 300° F. stream to produce by-product gas and a benzene-rich reformate stream;
(d) splitting the reformate stream into a benzene overhead stream and a toluene and xylene containing bottom stream;
(e) solvent extracting the benzene overhead stream to produce an essentially pure benzene product and a raffinate stream containing paraffinic hydrocarbons;
(f) processing the $C_5$ and lighter stream of step (a), the 300° F.+ stream of step (b), the by-product gas of step (c), and the raffinate stream of step (e) in a hydrogasification reactor to produce a light methane, ethane and benzene stream and a heavy aromatics stream;
(g) scrubbing the light methane, ethane and benzene stream with oil to remove a light aromatic benzene product stream;
(h) hydrodealkylating the toluene and xylene bottom stream of step (d) and the heavy aromatics stream of step (f) to produce a benzene product;
(i) cryogenically separating the light methane and ethane stream of step (g) to produce a synthetic natural gas and an ethane stream.

11. The method of claim 10 wherein the light aromatics are added to the benzene product from the hydrodealkylation step and further distilled wherein a non-benzene bottom stream is recycled to the hydrodealkylation step.

12. The invention of claim 10 or 11 wherein the heavy aromatics from the hydrogasification step (f) are distilled before hydrodealkylation in order to recover a net heavy aromatic product.

13. The invention of claim 10 wherein the hydrogasifier is a non-catalytic, thermal hydrogasification reactor.

14. The invention of claims 10, 11, or 13 wherein the reforming step is a catalytic dehydrogenation process.

* * * * *